US005437125A

United States Patent [19]

Barton, II

[11] Patent Number: 5,437,125

[45] Date of Patent: Aug. 1, 1995

[54] SURFACE POLISHING ASSEMBLY

[76] Inventor: Kenneth A. Barton, II, 1413 Airway Dr., Waterford, Mich. 48327

[21] Appl. No.: 149,012

[22] Filed: Nov. 8, 1993

Related U.S. Application Data

[63] Continuation of Ser. No. 851,871, Mar. 16, 1992, abandoned.

[51] Int. Cl.[6] ..... B24B 5/00

[52] U.S. Cl. ..... 451/8; 451/25; 451/49; 451/317; 451/304; 451/307

[58] Field of Search ..... 51/165 R, 165.74, 165.77, 51/165.9, 165.91, 289 R, 326, 328, 149, 150, 154, 135 R, 141, 142, 145 R

[56] References Cited

U.S. PATENT DOCUMENTS

| | | | |
|---|---|---|---|
| 1,993,543 | 3/1935 | Egger | 51/154 |
| 2,376,531 | 5/1945 | Egger | 51/154 |
| 4,747,234 | 5/1988 | Weber | 51/154 |
| 4,993,191 | 2/1991 | Judge et al. | 51/154 |
| 5,058,325 | 10/1991 | Pineau | 51/154 |

FOREIGN PATENT DOCUMENTS

| | | | |
|---|---|---|---|
| 531128 | 12/1940 | United Kingdom | 51/154 |
| 549423 | 11/1942 | United Kingdom | 51/154 |

*Primary Examiner*—M. Rachuba
*Attorney, Agent, or Firm*—Brooks & Kushman

[57] ABSTRACT

A universal surface polishing assembly movable along the longitudinal axis of a workpiece including a pair of polishing arms with a surface grinding material affixed to each end of the polishing arms respectively, a regulated cylinder for actuating the polishing arms onto the machine component bearing surface, and a pair of stabilizing plates located directly adjacent the polishing arms for stabilizing the polishing arms during the microfinishing operation. The surface polishing assembly is designed to be adapted to various machines having means for workpiece rotation such as grinders, lathes, mills etc. Many different machine components that require microfinishing of various bearing surfaces can be finished in the present invention due to the manual indexing ability inherent in the slidable polishing assembly.

11 Claims, 2 Drawing Sheets

Fig. 1
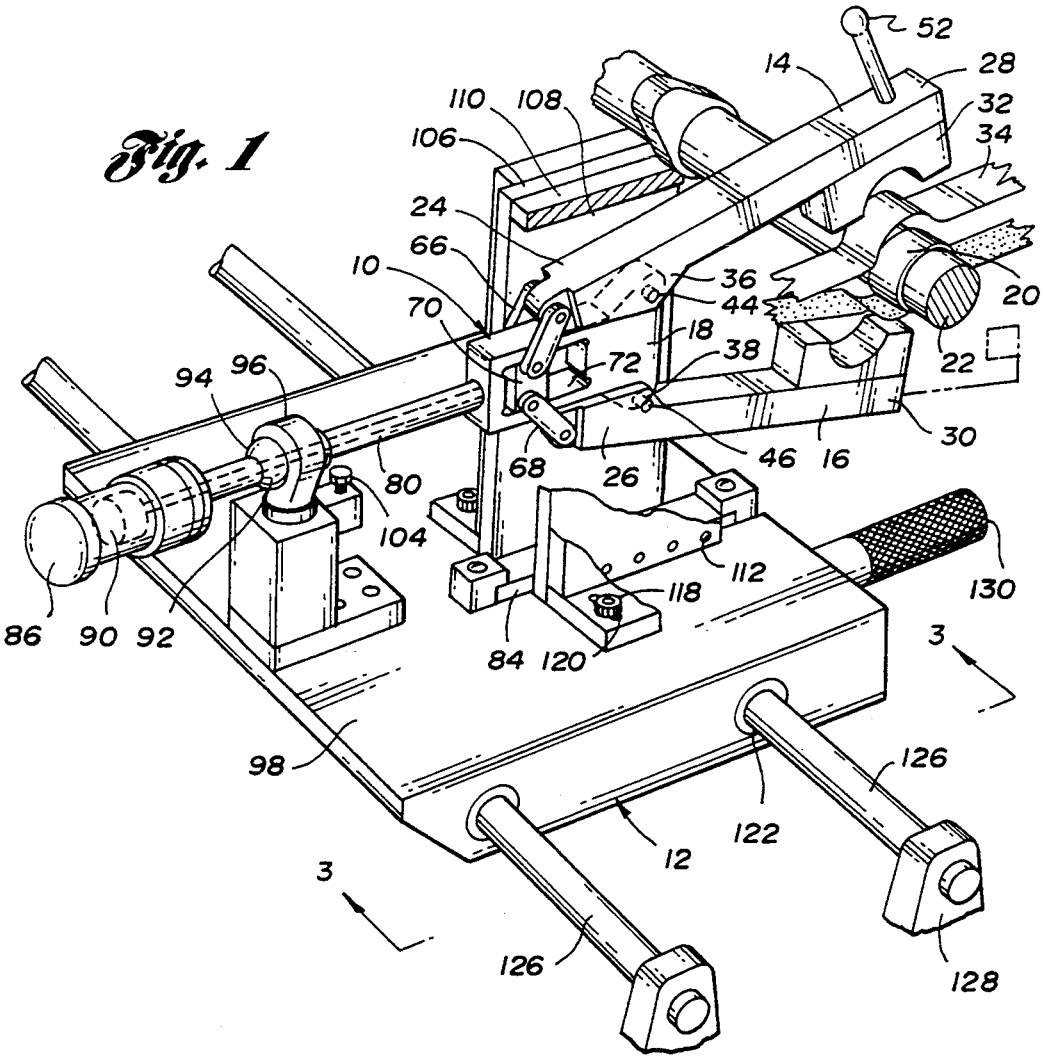
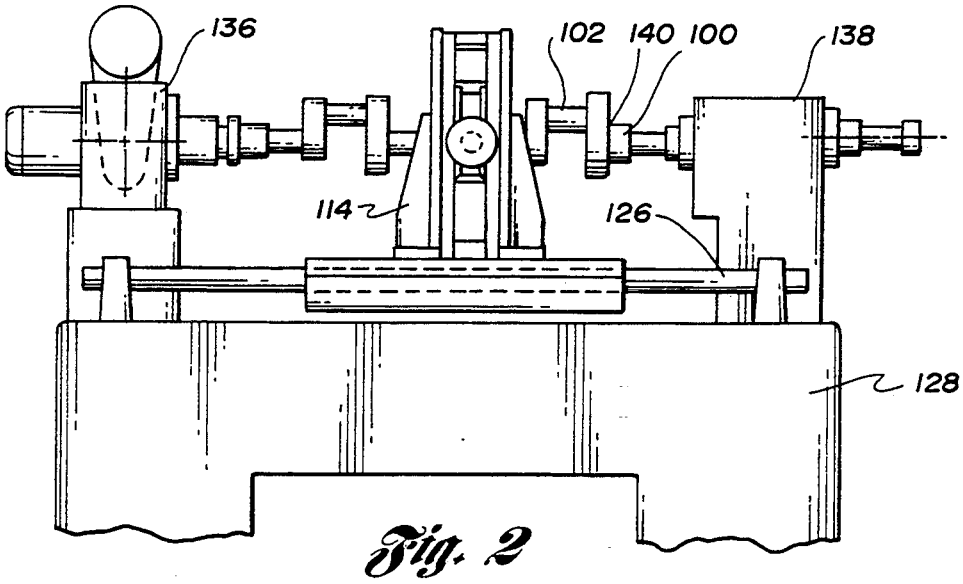
Fig. 2

SURFACE POLISHING ASSEMBLY

This is a continuation of application Ser. No. 07/851,871 filed on Mar. 16, 1992 now abandoned.

TECHNICAL FIELD

This invention relates generally to metal surface finishing and more particularly to an apparatus for microfinishing metal surfaces on various machine components.

BACKGROUND OF THE INVENTION

"Microfinishing" or "superfinishing" as it is known in the art, is a surface finishing process wherein a grinding means is brought to bear against a workpiece which has been previously rough ground. Microfinishing is a low velocity abrading process which generally follows rough grinding. Because microfinishing incorporates lower cutting speeds than grinding, heat and pressure variants may be minimized to provide improved size and geometry control. Those skilled in the art recognize that surface quality or roughness is measured in roughness average values ($R_a$) wherein $R_a$ is the arithmetical average deviation of minute surface irregularities from hypothetical perfect surfaces. Microfinishing can provide surface quality of approximately 1 to 10$\mu$ in. (0.025 to 0.25 $\mu$m). Bearing surfaces of crankshafts, cam shafts, power transmission shafts in similar machine components that rotate on journal bearing surfaces generally require this surface finish for satisfactory operation.

Conventional mass production microfinishing machines have the ability to finish all the bearing surfaces on a workpiece in one operation. These machines contain a plurality of abrasive tape segments which are aligned with respect to the bearing surfaces. In operation, the workpieces are rotated as the microfinishing machine causes abrasive tape segments to contact and thus finish the bearing surfaces. These large multi-abrading machines are capable of successive steps in one operation including rough grinding, grinding and microfinishing.

As is common in large scale production, failures may occur at one or more of the grinding areas or abrasive tape positions. As a result, workpieces may be produced with one or more bearing surfaces (but less than all bearing surfaces) which are not finished to the required surface quality specifications. In such cases, the grinding machine operator must then remove and scrap the defective workpiece. Because microfinishing is the final stage in surface treatment operations, i.e. after rough grinding and grinding, the scrapping of microfinished parts results in a substantial loss of both material and labor to the machinist.

Microfinishing processes are used in automotive applications in the manufacture, repair and rebuilding of internal combustion (IC) engines. Such engines not only require finely finished bearing surfaces for engine efficiency, but also for increased durability and longevity. In the initial manufacturing stage, crankshaft and camshaft bearing surfaces are microfinished to particular roughness specifications by previously mentioned, conventional mass production microfinishing machines.

In the repair or rebuilding stages, engine components such as crankshafts and cam shafts from faulty engines or older engines, are removed and reground to remove ten to thirty-thousandths of an inch of stock from the existing bearing surfaces. The bearing surfaces of these components are then polished or microfinished by placing the respective workpieces on a lathe and manually bringing a microfinishing material in contact with the rotating bearing surfaces. This microfinishing material is often a section of abrasive material mounted on a support correspondingly shaped to the bearing surface. It is generally recognized in the industry that these manual finishing operations are inadequate for achieving finished surfaces of standard quality.

Automotive repair and rebuilding operations microfinish very low volumes of engine components with respect to standard manufacturing operations. Special purpose crankshaft finishing machines such as disclosed in U.S. Pat. No. Re. 31,593 to Judge, Jr., reissued Jun. 5, 1984, are designed for low and medium volume workpiece production. These manufacturing machines are expensive and inappropriate for very low volume workpiece production or repair. Finishing machines of the type disclosed in the Judge, Jr. patent require programming of a computer controller for each different workpiece that requires finishing.

Automotive repair and rebuilding operations reclaim and refinish workpieces from hundreds of various internal combustion engines with different designs. Programmably controlling a finishing machine to accept each individual workpiece that requires microfinishing from different internal combustion engines is uneconomical and inefficient.

SUMMARY OF THE INVENTION

The surface polishing assembly of the present invention has been developed to meet the need for a manually controlled, low volume microfinishing machine that is capable of achieving finished surfaces of consistent quality on selected surfaces of previously incorrectly finished or worn workpieces. The surface polishing assembly has the versatility to accept many various families of machine components or workpieces which require bearing surface control finishing. The present invention, for example, can accept various families of cam shafts, crank shafts, axle shafts, transmission shafts, and compressor shafts without the need for programming of control sequences.

The present invention is also uniquely capable of serving as a manufacturing repair machine for correcting bearing surfaces on machine components previously microfinished by large, high volume microfinishing machines or as a very low volume microfinishing machine for automotive service repair and rebuilding operations.

The polishing assembly includes a pair of polishing arms pivotably affixed to a polishing body and adapted to receive various surface grinding materials for finishing bearing surfaces on workpieces. The polishing body is attached to a base which is movable with respect to the workpiece along the axis of rotation of the workpiece. A pair of stabilizing plates are employed to restrict the polishing arms to movement in a plane substantially perpendicular to the axis of rotation of the workpiece and are adjustably attached to the base.

In operation, the polishing assembly is manually indexed, bringing the polishing arms to a position adjacent the bearing surface to be microfinished. This manual indexing affords accurate and rapid operation and also allows for the accommodation of many families of machine components. The microfinishing machine operates without the need for time-consuming and expensive pre-programming of numerical control systems needed to index and operate automotive microfinishing machines.

Accordingly, it is an object of the present invention to provide a manually controlled surface polishing repair tool that is capable of microfinishing selected surfaces of previously incorrectly or worn finished bearing surfaces on a machine component or workpieces to process and tolerance specifications equal or exceeding automatic control equipment.

Another object of the present invention is to provide a surface polishing assembly including a surface polishing tool that is capable of accepting various families of machine components or workpieces that require microfinishing of selected bearing surfaces without modification.

A further object of the present invention is to provide a surface polishing assembly capable of microfinishing selected bearing surfaces on a previously machined workpiece without requiring pre-programmed computer instructions.

It is a still further object of the present invention to provide an improved surface polishing machine including a surface polishing assembly that is inexpensive to manufacture and operate in medium and low volume production microfinishing processes.

A more specific object of the present invention is to provide a surface polishing tool for use with a power means for rotating a workpiece about an axis having a body defining a track adapted to be positioned adjacent a workpiece including a first and second pivot means, a slide movable on the track, and first and second polishing arms pivotable on a respective pivot means. The polishing arms have a first end adapted to receive a surface grinding means for finishing a workpiece and a second end. A link means connects the slide to the respective second end of the first and second polishing arms for moving the arms about the first and second pivot means from a respective treatment, enabling position adjacent the workpiece to a respective treatment position where the surface grinding means engages the workpiece. The surfacing polishing tool also has an actuating means for movably engaging the slide to move the arms between the respective treatment enabling position and the respective treatment position.

Another more specific object of the present invention is to provide an improved surface polishing machine having a polishing assembly for microfinishing a surface of a workpiece rotatable about an axis having a base movable with respect to the workpiece along and adjacent the axis, a body having polishing arms pivotably affixed to said body and adapted to receive a surface grinding means on one end for finishing the workpiece, a support means affixable to the base for pivotably supporting the body with respect to the workpiece and a pair of stabilizing plates adjustably affixed to the base adjacent the body such that the stabilizing plate sufficiently restrict the body to movement in the plane substantially perpendicular to the axis of the workpiece.

The above objects and other objects, features and advantages of the present invention are readily apparent from the following detailed description of the best mode for carrying out the invention to be taken in connection with the accompanying drawings.

BRIEF DESCRIPTION OF THE DRAWINGS

FIG. 1 is a fragmentary perspective view of the surface polishing tool of the present invention, partly broken away to show the operation of a polishing arm;

FIG. 2 is a fragmentary elevational view of the polishing tool of the present invention, including a head stock and tail stock for rotating a workpiece;

DETAILED DESCRIPTION OF THE INVENTION

Figure 3:
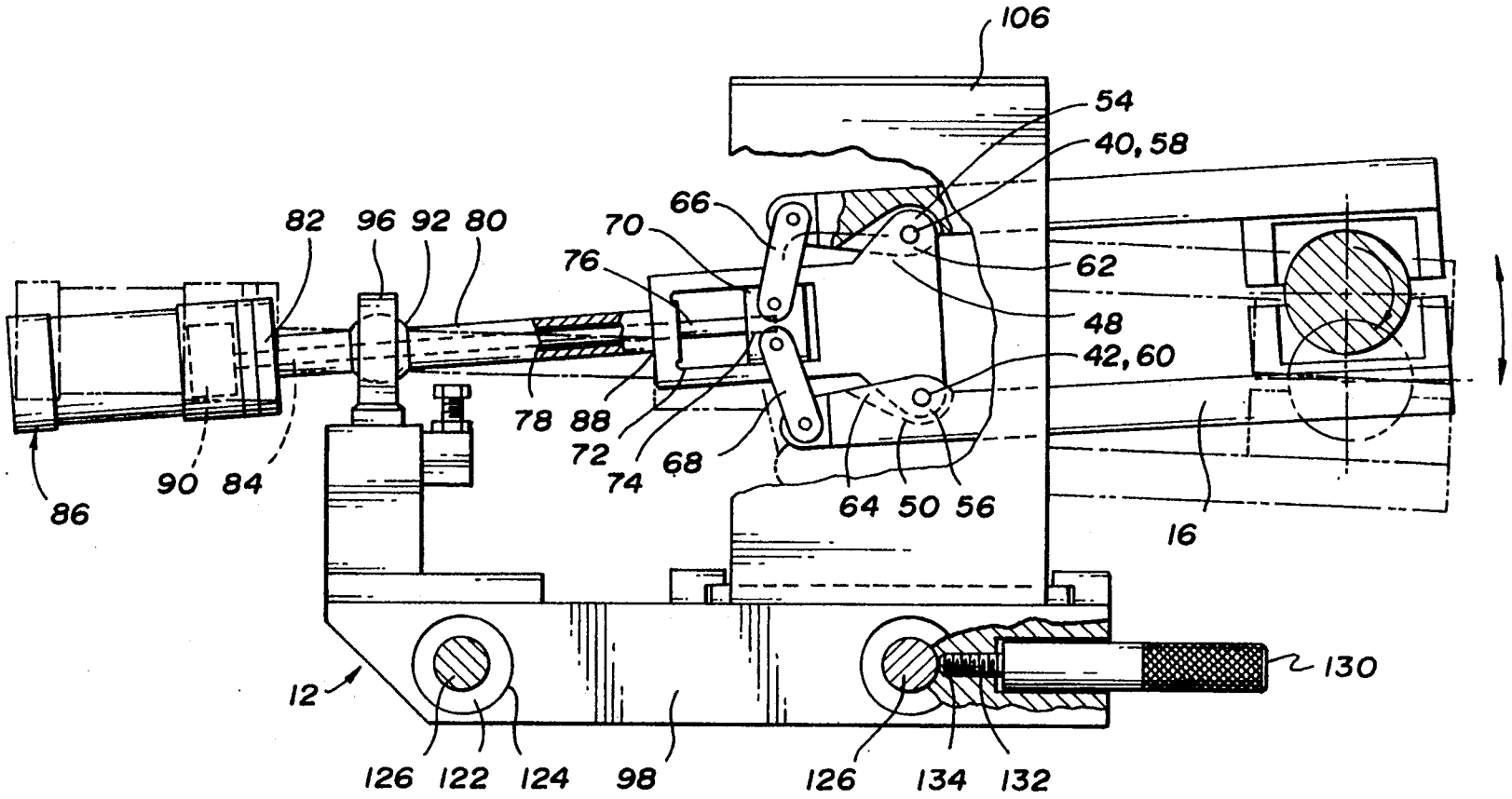
FIG. 3 is a fragmentary sectional view of the polishing tool of the present invention taken along line 3—3 in FIG. 1 and broken away to show the polishing tool in a treatment position (solid line) and in a pivoted position (phantom line) in response to rotation of the workpiece being treated.

With reference to FIG. 1, a surface polishing tool is shown generally designated by reference numeral 10. Polishing tool 10 is incorporated in the polishing assembly designated by reference numeral 12. Polishing tool 10 is shown having top and bottom polishing arms 14 and 16 which are both pivotally connected to the polishing tool body 18. The polishing arms 14 and 16 are shown in FIG. 1 in a treatment enabling position located above the bearing surface 20 of an automotive cam shaft 22.

Polishing arms 14 and 16 have first ends 24 and 26 adapted to be pivotably connected to body 18 and second ends 28 and 30 which are constructed to accept various families of grinding means depending on the workpiece and the extent of surface finishing required. Various grinding means may be attached to the second ends 28 and 30 of the polishing arms 14 and 16 by any suitable fastening means. FIG. 1 shows one example of a grinding means, an abrasive-coated tape grinding system using tape back-up shoes 32 and coated abrasive tape 34. Common abrasive tape feed and take-up mechanisms are not shown. Other grinding materials include honing stones using diamond, carborundum, garnet, cubic boron nitride and other like substances.

Referring now to FIGS. 1 and 3, there is shown a pair of abrasive-coated tape back-up shoes 32 adapted to receive the bearing surfaces of a workpiece such as cam shaft 22. Abrasive-coated tape 34 is shown adjacent tape back-up shoes 32 to further illustrate the relative positions of back-up shoes 32, abrasive-coated tape 34 and bearing surface 20 during operation of the polishing assembly. Disposed between first ends 24 and 26 and second ends 28 and 30 of top and bottom polishing arms 14 and 16 are identical pairs of connecting members 36 and 38 which extend from respective arms 14 and 16. Connecting members 36 and 38 have throughbores 40 and 42, respectively, which accept pivot pins 44 and 46, respectively.

Polishing arms 14 and 16 have hollowed recesses 48 and 50 disposed between the pairs of connecting members 36 and 38. Upper polishing arm 14 has a handle 52 for bringing upper polishing arm 14 and lower polishing arm 16 forward to the treatment position.

Still referring to FIGS. 1–3, polishing tool body 18 is shown having a pair of extending sections 54 and 56 which have respective throughbores 58 and 60 disposed thereon. The connecting members of the polishing arms are adapted to cooperate with the extending sections of the tool body. Throughbores 40 and 42 are of the same diameter as the throughbores 58 and 60 of the polishing arms to allow pivot pins 44 and 46 to be located inside the throughbores and the polishing arm bores.

The polishing arms 14 and 16 are thus pivotably connected to the polishing tool body 18 by placing the connecting members 36 and 38 of polishing arms within the extending sections 54 and 56. Extending sections 54 and 56 have recesses 62 and 64 for receiving the connecting members of the polishing arms 14 and 16. Pivot pins 44 and 46 are press fit inside the throughbores and work as pivoting members for the polishing arms. The surface polishing tool 10 of the present invention is designed to operate with two polishing arms connected to the polishing tool body but it is contemplated that microfinishing may also be accomplished with just one polishing arm.

Referring to FIGS. 1 and 3, the second ends 28 and 30 of the polishing arms 14 and 16 are pivotally connected to two pairs of metal links 66 and 68. The pairs of metal links 66 and 68 are identical and are disposed on opposite sides of the second ends 28 and 30 of the polishing arms. The pairs of metal links 66 and 68 are connected at their other end to slide block 70 forming a push type toggle mechanism. Slide block 70 is disposed within hollow track 72 defined within polishing tool body 18.

Hollow track 72 is configured to allow sliding engagement between slide block 70 and track 72. Slide block 70 has a threaded hole 74 for receiving and connecting to tie rod 76. Tie rod 76 extends within hollow chamber 78 of sleeve 80 which is attached at one end 82 to track 72.

The actuating end 84 of tie rod 76 is positioned in a fluid motor such as either a regulated hydraulic or regulated pneumatic cylinder, generally indicated as 86 which is attached to the other end 88 of the sleeve 80. This regulated cylinder 86 is operated by a manual control, not shown, to extend the actuating piston 90 of the regulated cylinder 86 to which the tie rod end 84 is connected. As the actuating piston 90 is reciprocated according to the manual operation of the regulated cylinder, the tie rod is reciprocated moving the slide block within track 72. Tie rod 76 and regulated cylinder 86 act in conjunction with slide block 70 as an actuating means for moving the arms to embrace the surface on the workpiece to be finished.

Referring to FIGS. 1 and 3, as slide block 70 moves laterally in a first direction toward the workpiece from a first starting position to a second end position (shown in FIG. 3), it forces the pairs of metal links 66 and 68 to move to a vertical position and thus force polishing arms 14 and 16 to pivot around pivot pins 44 and 46. This brings first ends 24 and 26 having a grinding means to bear upon the workpiece bearing surface. Movement of the slide block 70 in a second direction opposite said first direction, correspondingly opens polishing arms 14 and 16 as shown in FIG. 1.

Different regulated cylinders with different bores and different stroke lengths produce different finishing pressures on the machine component. The pneumatic regulated cylinder 86 shown in FIGS. 1 and 3 has a one-and-one-half inch bore with a two inch stroke length. Using this size cylinder in cooperation with the predetermined pivot position of each polishing arm and the links, the finishing pressure at the grinding means position using approximately 60 psi of line pressure is approximately 200–300 pounds per square inch.

Compressive contact between the grinding means contained on the polishing arms 14 and 16 and the workpiece surface as the workpiece is being rotated about its longitudinal axis creates the microfinishing action that finishes the surface of the workpiece. FIG. 3 shows a polishing assembly of the present invention with one surface polishing tool 10 affixed. Surface polishing tool 10 is pivotally supported upon polishing assembly 12 by a spherical bearing 92 having an aperture 94 adapted to slidably receive sleeve 80. Spherical bearing 92 is journaled within housing 96 which is connected to base 98 of polishing assembly 12.

Still referring to FIG. 3, sleeve 80 is journaled within aperture 94 of spherical bearing 92. Spherical bearing 92 and housing 96 act as a support means for pivotably supporting the surface polishing tool 10 and allows for movement of the polishing tool. Specifically, the use of spherical bearing 92 and housing 96 allow for vertical, pivotal movement of surface polishing tool 10. This vertical movement is important when microfinishing crank shaft pin surfaces. As shown in FIG. 2, crank shaft 100 includes a plurality of cylindrical pin bearing surfaces 102 and main bearing surfaces 140 which must be correctly microfinished for correct operation. Adjustable positive stop 104 is located directly below sleeve 80 to prevent the polishing tool assembly from travelling too far down in the idle position.

For adequate microfinishing of pin bearing surfaces the entire polishing tool 10 must be movable with respect to the throw of the crank shaft pin bearings. This flexibility is necessary because the bearing surfaces of the pin bearings are positioned eccentrically with respect to the center of rotation of the crankshaft. As shown in FIG. 3, the polishing tool 10 can pivot vertically corresponding to the orbit of most crank shafts. The pivotal connection between the spherical bearing 92 and the sleeve 80 allows for surface polishing tool 10 to orbit with conventional pin bearing surfaces located on most crank shafts.

As shown in FIGS. 1 and 3, a pair of stabilizing plates 106 are located directly adjacent the surface polishing tool 10. Stabilizing plates 106 stabilize the surface polishing tool 10 against lateral and angular movement during the finishing operation. Stabilizing plates 106 are positioned adjacent the surface polishing tool 10 with a minimum running clearance between surface polishing tool 10 and the inner walls 108 of the stabilizing plates. This minimum running clearance is achieved by locating the stabilizing plates adjacent the surface polishing tool to a point where sliding contact is made between the surface polishing tool and the stabilizing plates. Spacers 110 are disposed between stabilizing plates 106 to allow for stabilizing pressure to be uniformly applied along the stabilizing plates. The stabilizing plates 106 are affixable to spacers 110 by fastening screws 112.

FIG. 2 shows an alternative embodiment of the present invention with adjustable clamping fixtures 114 and 116 located directly adjacent the stabilizing plates. These clamping fixtures may be utilized to provide additional lateral support during the microfinishing process. Screw fasteners 118 are disposed within adjustment slots 120 as shown in FIG. 1, and are used to lock the clamping fixtures not fully shown in FIG. 1 in place.

The addition of multiple arms and stabilizing plates allows the polishing assembly to go from a single surface polishing assembly to a multiple surface polishing assembly where more than one surface has previously been incorrectly finished. Polishing assembly base 98 may be manufactured in any dimension to accept as many surface polishing tools as needed. Additional stabilizing plates 86 can be positioned adjacent the additional surface polishing tools.

Base 98 incorporates ball bushings or bearings 122 positioned within slide bores 124 within the base 98. These bearings allow the entire polishing assembly 12 to slide along rails 126 contained on polishing support table 128 as shown in FIG. 2.

A handle 130 is affixed to base 98 to aid in sliding the polishing assembly 12 along rails 126. The mobility of polishing assembly 12 is integral to the operation of the polishing assembly. When only one surface polishing tool is being utilized on the polishing assembly 12, successive bearing surfaces can be microfinished on one workpiece by simply indexing the polishing assembly along the axis of the workpiece and finishing a new surface each time. Polishing assembly 12 can be adapted to be affixed to any lathe type rotational grinding machine which is capable of affording lateral movement of the base.

In addition, handle 130 includes a threaded portion 132 that extends into tapped bore 134 which extends into contact with slide rail 126. This handle 130 may be used as a locking means for securing polishing assembly 12 in one location along slide rails 126. Handle 130 can be rotated to a position wherein threaded portion 132 contacts slide rail 126 and acts as a set screw in securing the polishing assembly in one location. This locking means is particularly useful for microfinishing a series of machine components wherein a particular bearing surface along the length of a machine component is out of specification in a number of machine components.

Handle 130 is also utilized when an operator wishes to induce an oscillating lateral movement in the polishing assembly. This lateral oscillating movement is used by the operator to control the resulting surface tool pattern that is created on the bearing or process surface being finished by the grinding means being used. A handle 130 is also used to move the polishing tool assembly laterally along a predetermined length of process surface of the workpiece when the surface to be finished has a greater width than the grinding means.

The surface polishing machine of the present invention as shown in FIG. 2, includes a head stock 136 and a tail stock 138 which together cooperate to rotate a machine component or workpiece such as a crankshaft 100 about its longitudinal center axis. To microfinish the crank shaft shown in FIG. 2, the regulated cylinder must be operated so as to retract (FIG. 1) the actuating piston 90 which in turn retracts the tie rod 76 within the hollow chamber 78. As the tie rod 76 retracts, slide block 70 moves laterally towards the regulated cylinder which in turn moves metal links 66 and 68 such that polishing arms 14 and 16 separate. Crank shaft 100 is next placed within head stock 136 and tail stock 138.

Regulated cylinder 86 is next activated to move actuating piston 90 out and toward polishing tool body 18. Actuating piston 90 moves laterally and thus moves tie rod 76 and slide block 70. As slide block 70 moves toward crank shaft 100, polishing arm 14 and 16 encircle or embrace the bearing surface of crank shaft 100. The operator of the machine regulates the pressure of cylinder 86 until the requisite amount of pressure is supplied upon abrasive-coated tape 34 contained on polishing arms 14 and 16.

This amount will vary according to different polishing surface diameters and widths of the bearing on the machine component. The speed that the workpiece is being rotated by the head stock and the duration the grinding means contacts the bearing surface also effects the roughness average values achieved on the bearing surface. Using a common abrasive tape grinding means with a roughness rating of 20 $\mu$m, and rotating the workpiece at 100 rpms, a pressure of approximately 100 psi for 15 seconds induces a roughness value of approximately 15 $R_a$.

The surface polishing assembly according to the present invention, as stated earlier, can be used in large scale manufacturing processes in the industry to recover workpieces scrapped at the microfinishing stage. This is accomplished by removing the scrapped workpiece from the microfinishing machine after an out of specification or incorrect bearing surface has been identified and installing it within the surface polishing assembly of the present invention.

The machine operator may then microfinish the particular bearing surface to the required specification, and thus reclaim the workpiece from scrap. As is known in the industry, machine components that are at the microfinishing stage represent the highest economic investment in the manufacturing process and it is thus very desirable to reclaim the workpiece at these late stages.

Manual microfinishing procedures of the prior art are inherently subjective to the operator performing the procedure and thus may be inadequate in achieving standard surface finishes required for modern internal combustion engine components. The surface finishing assembly of the present invention is able to achieve standard surface finishes on a consistent basis, with consistent quality, and are able to achieve microfinishing levels suitable for modern internal combustion engine components.

Automotive repair and rebuild operations, as stated previously, often remove machine components from engines and microfinish bearing surfaces contained on those components. The surface polishing assembly of the present invention can be utilized to microfinish these various components with a degree of standardization that is higher than prior art procedures. In addition, the surface polishing assembly is configured to accept machine components from many different internal combustion engines. The surface polishing assembly can thus accept crankshafts and camshafts from single cylinder, to multiple cylinder engines without significant modifications.

It can be seen from the above disclosure, that the surface polishing assembly of the present invention is flexible enough to accommodate many various workpieces and can also surface finish many different surfaces on a particular workpiece. The ability to accept many different machine components and also to finish many different surfaces along the component without having to program automatic computer sequences makes the present invention economically desirable as compared to other large, dedicated microfinishing machines known in the industry.

While the best mode for carrying out the invention has been described in detail, those familiar with the art to which this invention relates will recognize various alternative designs and embodiments for practicing the invention as defined by the following claims.

What is claimed is:

1. A surface polishing tool for attachment to various power means for rotating a workpiece about an axis in a finishing process, said workpiece having at least one process surface, said polishing tool comprising:

a body defining a track adapted to be positioned adjacent said workpiece, said body including first and second pivot means for supporting a pair of spaced apart polishing arms, said first and second pivot means located adjacent said track;

a first polishing arm pivotable on said first pivot means, said first arm having a first end adapted to receive a surface grinding means for finishing said process surface of said workpiece and a second end;

a second polishing arm pivotable on said second pivot means, said second arm having a first end adapted to receive said surface grinding means for finishing said process surface of said workpiece and a second end;

a slide block disposed within said track and movable in a controlled first direction towards said workpiece between a first starting position and a second ending position, said slide having a first side and a second side;

a first push type toggle means for pivotally connecting said second end of said first polishing arm to said first side of said slide;

a second push type toggle means for pivotally connecting said second end of said second polishing arm to said second side of slide wherein movement of said slide from said first starting position to said second ending position within said track moves said polishing arms about said first and second pivot means from a respective treatment enabling position spaced from said workpiece to a respective treatment position wherein said surface grinding means engages said workpiece;

actuating means for movably engaging the slide to move the polishing arms between said respective treatment enabling position and said respective treatment position, said actuating means including a tie rod connected to said slide and a sleeve affixed at one end to said body for guiding said tie rod, wherein said tie rod has a first end affixable to a regulated fluid cylinder and a second end affixable to the slide for operatively reciprocating said tie rod in said first direction, thereby moving said slide and correspondingly moving said polishing arms about said first and second pivot means;

a sliding base affixable to said body and manually movable linearly with respect to said workpiece along and adjacent to said axis of rotation of said workpiece, thereby allowing said polishing arms to be located with respect to said process surface disposed on said workpiece and allowing said polishing arms to be manually oscillated along a predetermined length of the process surface during said finishing process;

a pair of rigid, stabilizing plates mounted directly to the base independently of said polishing arms or said body, said plates disposed adjacent to and on opposite sides of the body, said plates disposed in abutting engagement with said body but sufficiently spaced apart a minimum running clearance to allow movement of the arms in a vertical plane substantially perpendicular to said axis, said plates encompassing a sufficient portion of the polishing arms to maintain a minimum of angular and lateral movement of the polishing arms with respect to said stabilizing plates; and a bearing means for slidably supporting said sleeve, wherein said bearing means allows movement of said sleeve and first and second polishing arms in said first direction toward said workpiece and away from workpiece in an opposite second direction thereby affording manual movement of said polishing arms in said first and second directions to assist in locating the polishing arms in said treat enabling position.

2. The surface polishing tool of claim 1 wherein the surface grinding means is an abrasive tape.

3. The surface polishing tool of claim 1 wherein the first ends of said first and second polishing arms include inserts adapted to receive surface grinding means.

4. The surface polishing tool of claim 1 wherein said bearing means further pivotally supports said sleeve to permit movement of the body in an eccentric path in response to rotation of the workpiece.

5. The surface polishing tool of claim 1 wherein said bearing means includes:

a housing affixable to said base; and a spherical bearing supported in said housing and having an aperture for slidably receiving said sleeve, said spherical bearing being journaled within said housing to permit said body to pivot with respect to the base.

6. A surface polishing machine for polishing a workpiece having at least one process surface, said surface polishing machine comprising:

a power means for rotating a workpiece about an axis in a finishing process;

a body defining a track adapted to be positioned adjacent said workpiece, said body including first and second pivot means for supporting a pair of spaced apart polishing arms, said first and second pivot means located adjacent said track;

a first polishing arm pivotable on said first pivot means, said first arm having a first end adapted to receive a surface grinding means for finishing said process surface of said workpiece and a second end;

a second polishing arm pivotable on said second pivot means, said second arm having a first end adapted to receive said surface grinding means for finishing said process surface of said workpiece and a second end;

a slide block disposed within said track and movable in a controlled first direction towards said workpiece between a first starting position and a second ending position, said slide having a first side and a second side;

a first push type toggle means for pivotally connecting said second end of said first polishing arm to said first side of said slide;

a second push type toggle means for pivotally connecting said second end of said second polishing arm to said second side of slide wherein movement of said slide from said first starting position to said second ending position within said track moves said polishing arms about said first and second pivot means from a respective treatment enabling position spaced from said workpiece to a respective treatment position wherein said surface grinding means engages said workpiece;

actuating means for movably engaging the slide to move the polishing arms between said respective treatment enabling position and said respective treatment position, said actuating means including a tie rod connected to said slide and a sleeve affixed at one end to said body for guiding said tie rod, wherein said tie rod has a first end affixable to a regulated fluid cylinder and a second end affixable to the slide for operatively reciprocating said tie rod in said first direction, thereby moving said slide and correspondingly moving said polishing arms about said first and second pivot means;

a sliding base affixable to said body and manually movable linearly with respect to said workpiece along and adjacent to said axis of rotation of said workpiece, thereby allowing said polishing arms to be located with respect to said process surface disposed on said workpiece and allowing said polishing arms to be manually oscillated along a predetermined length of the process surface during said finishing process;

a pair of rigid, stabilizing plates mounted directly to the base independently of said polishing arms or said body, said plates disposed adjacent to and on opposite sides of the body, said plates disposed in abutting engagement with said body but sufficiently spaced apart a minimum running clearance to allow movement of the arms in a vertical plane substantially perpendicular to said axis, said plates encompassing a sufficient portion of the polishing arms to maintain a minimum of angular and lateral movement of the polishing arms with respect to said stabilizing plates; and a bearing means for slidably supporting said sleeve, wherein said bearing means allows movement of said sleeve and first and second polishing arms in said first direction toward said workpiece and away from workpiece in an opposite second direction thereby affording manual movement of said polishing arms in said first and second directions to assist in locating the polishing arms in said treat enabling position.

7. The surface polishing machine of claim 6 wherein the surface grinding means is an abrasive tape.

8. The surface polishing machine of claim 6 wherein the first ends of said first and second polishing arms include inserts adapted to receive surface grinding means.

9. The surface polishing machine of claim 6 wherein said bearing means further pivotally supports said sleeve to permit movement of the body in an eccentric path in response to rotation of the workpiece.

10. The surface polishing machine of claim 6 wherein said bearing means includes:

a housing affixable to said base; and a spherical bearing supported in said housing and having an aperture for slidably receiving said sleeve, said spherical bearing being journaled within said housing to permit said body to pivot with respect to the base.

11. The surface polishing machine of claim 6 wherein said first push type toggle means, first polishing arm and body define a three point pivotal clamping means for applying a clamping force at said process surface.

* * * * *